US006537041B2

(12) United States Patent
Lee

(10) Patent No.: US 6,537,041 B2
(45) Date of Patent: Mar. 25, 2003

(54) TENSION GENERATING MEANS FOR REDUCING VIBRATIONS IN A HERMETIC COMPRESSOR DISCHARGE LINE TUBE

(75) Inventor: Sung-tae Lee, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/946,888

(22) Filed: Sep. 5, 2001

(65) Prior Publication Data

US 2002/0127123 A1 Sep. 12, 2002

(30) Foreign Application Priority Data

Mar. 12, 2001 (KR) ..... 01-12733

(51) Int. Cl.[7] ..... F04B 17/00

(52) U.S. Cl. ..... 417/415; 417/902; 417/572; 248/617

(58) Field of Search ..... 417/415, 902, 417/410.1, 572; 248/617

(56) References Cited

U.S. PATENT DOCUMENTS

| | | | | |
|---|---|---|---|---|
| 2,721,029 A | * | 10/1955 | Grimshaw | 417/902 |
| 3,154,245 A | * | 10/1964 | Roelsgaard | 417/902 |
| 3,246,836 A | * | 4/1966 | Ayling | 417/902 |
| 4,401,418 A | * | 8/1983 | Fritchman | 417/902 |
| 4,449,895 A | * | 5/1984 | Kurahayashi | 417/902 |
| 5,059,100 A | * | 10/1991 | Quesada et al. | 417/902 |

* cited by examiner

*Primary Examiner*—Cheryl J. Tyler
(74) *Attorney, Agent, or Firm*—Ladas & Parry

(57) ABSTRACT

A compressor is capable of reducing vibration and noise produced during a discharge of compressed refrigerant through a discharge line tube. The discharge line tube of the compressor has a bent portion to reduce vibration and noise when the compressed refrigerant is discharged into a discharge pipe. The compressor includes an elastic member having hooks formed on both ends thereof, for generating a predetermined tension while being supported on the bent portion of the discharge line tube on two locations. Since vibration and noise can be reduced significantly, appliances that require the compressor as an essential element can provide optimum environment to users.

6 Claims, 7 Drawing Sheets

TENSION GENERATING MEANS FOR REDUCING VIBRATIONS IN A HERMETIC COMPRESSOR DISCHARGE LINE TUBE

BACKGROUND OF THE INVENTION

1. Field of the Invention

The present invention relates to a compressor, and more particularly to a compressor capable or reducing vibration and noise that is produced while compressed refrigerant is discharged through a discharge line tube.

2. Description of the Related Art

Generally, a compressor used in a refrigeration cycle device is constructed in a manner that refrigerant is compressed into high temperature and high pressure refrigerant and discharged therefrom.

FIGS. 1 and 2 are sectional views showing internal structure of the compressor from a front and rear view, respectively.

As shown in FIGS. 1 and 2, the compressor 200 includes a sealed casing 110, a compressing mechanism 100, enclosed by the sealed casing 110 for compressing and discharging the refrigerant, and a suction pipe 102 and a discharge pipe 104 passed through the sealed casing 110 from the compressing mechanism 100, respectively.

The operation of the compressing mechanism 100 of the compressor, constructed as above, will be described below.

First, as power is supplied, a motor is driven. By the driving of the motor, a crank shaft 1 is rotated, and accordingly, a connecting rod 17 is linearly reciprocated by an eccentric shaft 19 of the crank shaft 1. A cylinder of a piston 16 strokes for drawing in and discharging out the refrigerant according to a movement of the connecting rod 17. At this time, the refrigerant drawn into the cylinder is compressed, and such compressed refrigerant is discharged through the discharge pipe 104 via a valve plate 11 and a cylinder head 38. Meanwhile, the discharged refrigerant from the discharge pipe 104 reaches an evaporator (not shown), which takes a part in the refrigeration cycle, and evaporated therefrom. The evaporated refrigerant gas is drawn into a suction muffler 4 through the suction pipe 102 of the compressor 200. The gaseous refrigerant flows through a suction muffler base 5 and a suction hole 6 of the valve plate 11, and opens the suction valve 8 to be drawn into a block bore cylinder 9. Then the piston 16 is returned to an upper dead end position to compress the gaseous refrigerant. The compressed refrigerant pushes the discharge valve 10 through the valve plate 11, and flows into the discharge muffler 33 via a discharge chamber 12 of the cylinder head 38. The compressed refrigerant is then discharged through the discharging pipe 104, after passing through a baffle path 34 and discharge muffler cover 18 provided for releasing the refrigerant shock.

Here, the compressed refrigerant is transferred through the discharge line tube 31 of FIG. 3 from the discharge muffler cover 18 to the discharge pipe 104. The discharge line tube 31 is bent for reducing vibration and noise that are produced during the discharge of the refrigerant. Further, a coil spring 32 is disposed around an outer circumference of the discharge line tube 31 for damping the vibration.

Although the discharge line tube 31 is bent and the coil spring 32 is wound around such bent discharge line tube 31 for the purpose of reducing the vibration and noise produced from the discharge line tube 31, the vibration and noise from the compressor is not sufficiently reduced. Further, due to a gap between the discharge line tube 31 and the coil spring 32 wound around the outer circumference of the discharge line tube 31, the discharge line tube 31 and the coil spring 32 collide with each other while the compressor is driven, generating a noise.

Since the level of the noise produced from the collision of the coil spring 32 and the discharge line tube 31 falls into an audio-frequency range, i.e., 2.5 kHz–3.15 kHz, the noise particularly annoys users.

SUMMARY OF THE INVENTION

The present invention has been made to overcome the above-mentioned problems of the related art, and accordingly, it is an object of the present invention to provide a compressor capable of reducing vibration and noise produced during a discharge of compressed refrigerant through a discharge line tube.

The above object is accomplished by a compressor according to the present invention, including a sealed casing, a compressing mechanism mounted in the sealed casing, for compressing and discharging an inflow of refrigerant, a suction pipe passed through the sealed casing, the suction pipe through which the refrigerant flows into the compressing mechanism from outside of the sealed casing, a discharge pipe passed through the sealed casing, the discharge pipe through which the refrigerant is discharged from the compressing mechanism outside of the sealed casing, a discharge line tube disposed between the compressing mechanism and the discharge pipe, and having a bent portion for reducing a vibration and a noise produced during a discharge of the refrigerant, and an elastic member supported on the bent portion of the discharge line tube on two locations for generating a predetermined tension.

BRIEF DESCRIPTION OF THE DRAWINGS

The above object and other features of the present invention will be clarified by the following description with the attached drawings, in which.

DETAILED DESCRIPTION OF THE PREFERRED EMBODIMENTS

Figure 1:
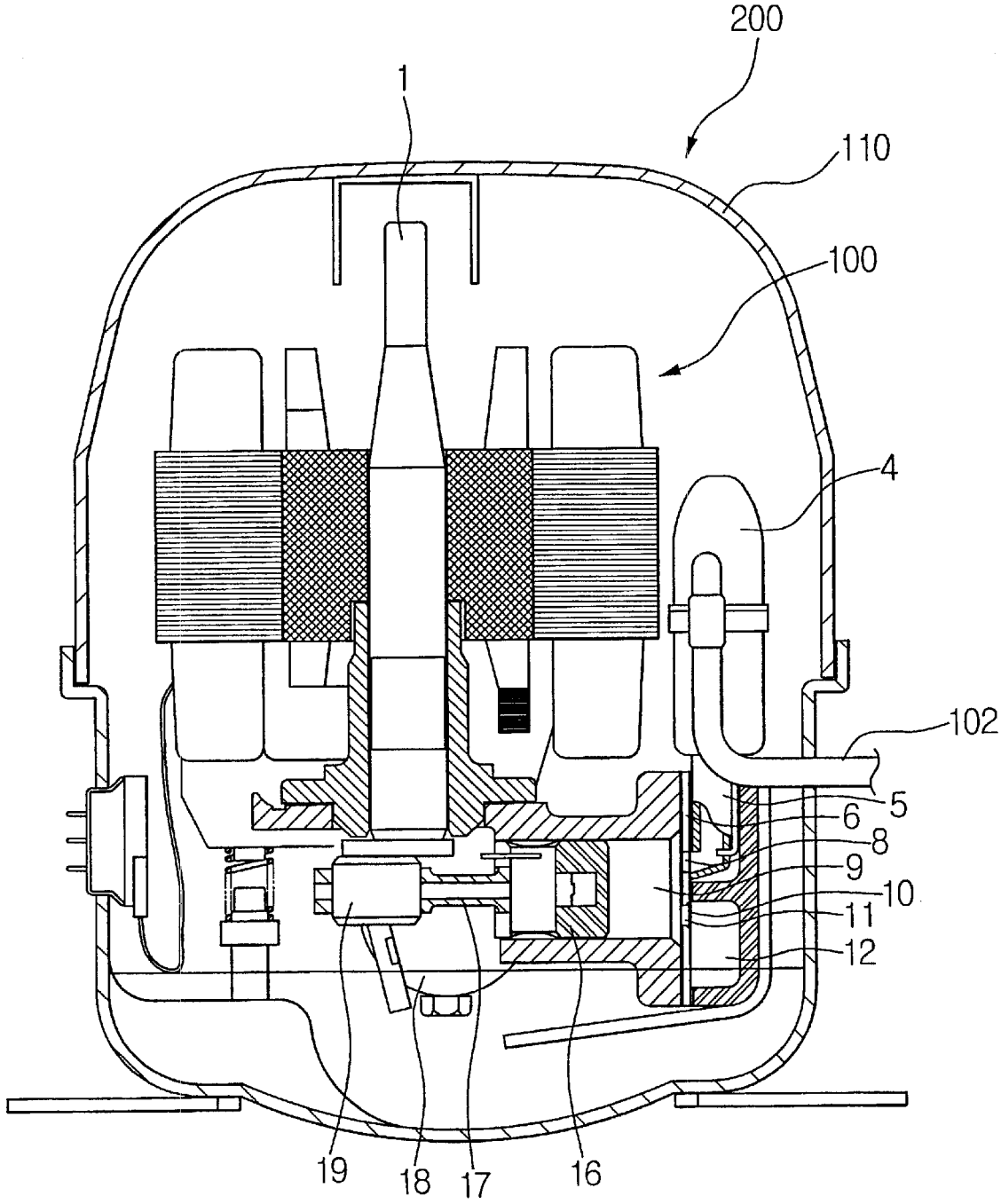
FIG. 1 PRIOR ART
FIG. 1 is a front sectional view of a conventional compressor.
Figure 2:
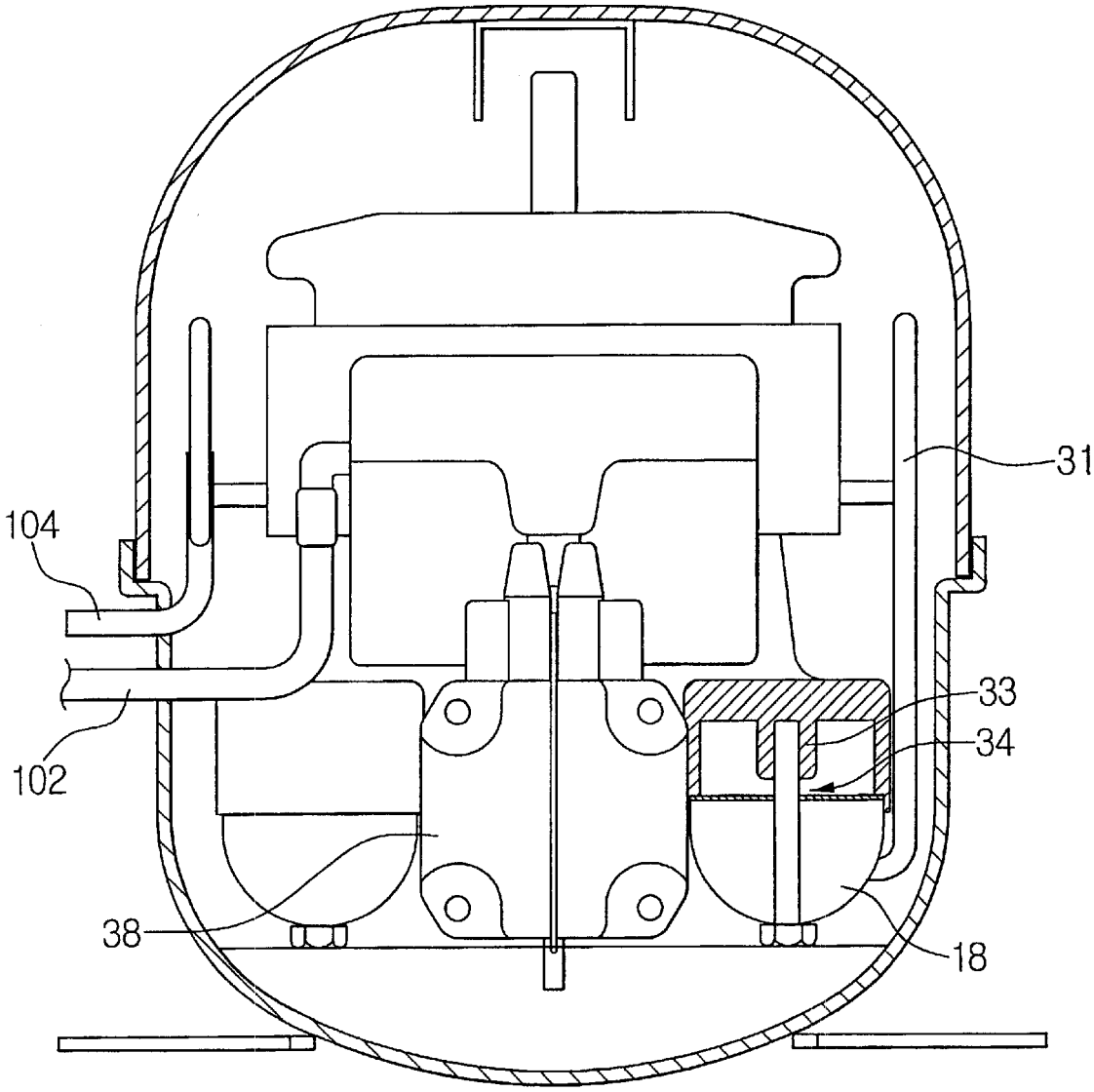
FIG.2 PRIOR ART
FIG. 2 is a rear sectional view of FIG. 1.
Figure 3:
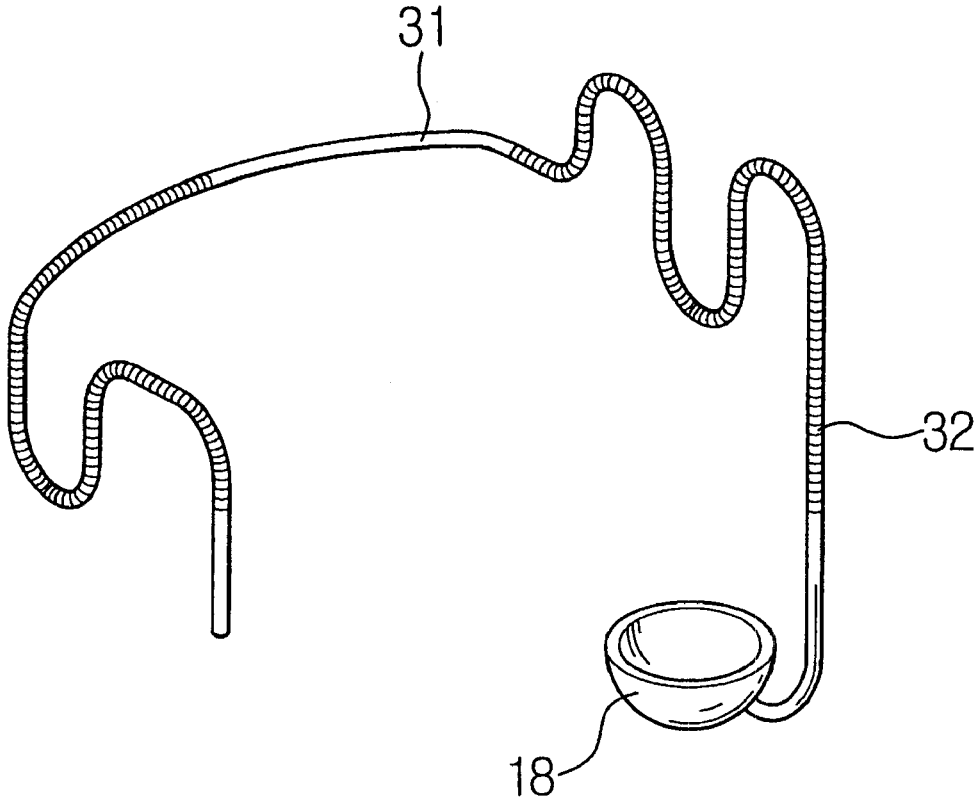
FIG.3 PRIOR ART
FIG. 3 is a perspective view of a discharge line tube used for the conventional compressor.
Figure 4:
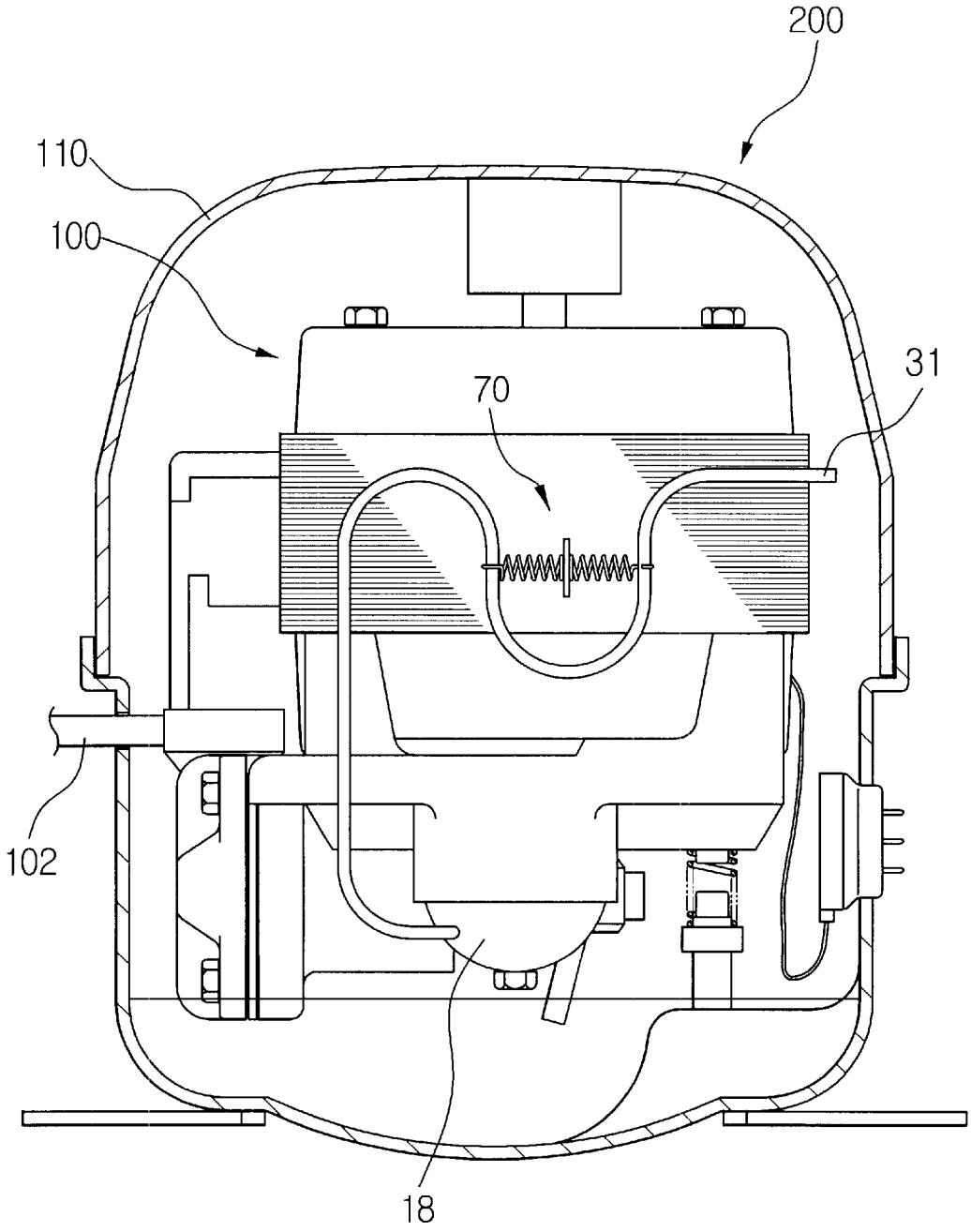
FIG. 4 is a view showing a compressor according to the present invention.

This invention will be described in further detail by way of example with reference to the drawing figures. Throughout the description, the like elements will be given the same reference numerals while repetitious description will be omitted as much as possible. Also, a plurality of elements is collectively referred by one representative reference numeral. FIG. 4 shows the compressor according to the present invention. As shown in FIG. 4, the compressor 200 according to the present invention includes a sealed casing 110, a compressing mechanism 100 enclosed by the sealed casing 110, and a suction pipe 102 passed through the sealed casing 110 from the compressing mechanism 100.

The compressing mechanism 100 includes a discharge line tube 31 disposed between a discharge muffler cover 18 and a discharge pipe (not shown) and having a bent portion, and an elastic member 70 disposed on the bent portion of the discharge line tube 31.

Figure 5:
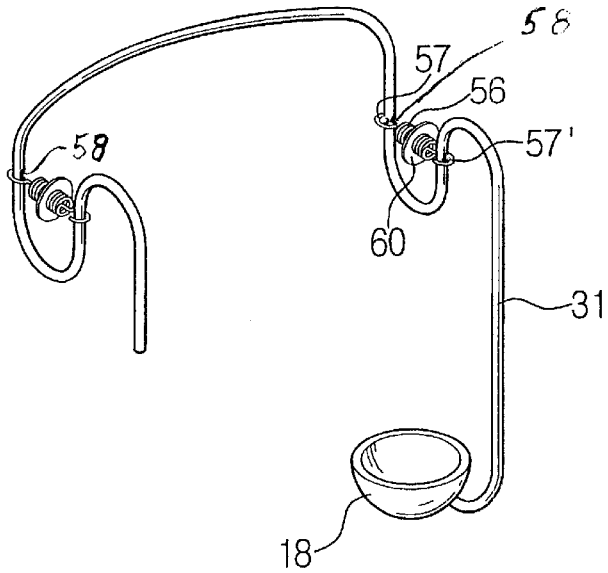
FIG. 5 is a view showing the discharge line tube and an elastic member being disposed around he discharge line tube in the compressor of FIG. 4.

FIG. 5 is a view showing the discharge line tube 31 of the compressor of FIG. 4 and the elastic member 70 being disposed on the bent portion of the discharge line tube 31.

Referring to FIG. 5, the discharge line tube 31 is bent twice into a U-shape and is connected to the discharge muffler cover 18. Springs 56 with hooked ends 57 and 57' formed on respective ends thereof are disposed on the U-shaped bent portions of the discharge line tube 31 to generate a predetermined tension. Each spring 56 is coupled with a mass 60 of a predetermined weight. It is preferable that the bent portions of the discharge line tube 31 have locking grooves 58 to receive the hooks 57 and 57' of the springs 56, or projections 59 (FIG. 7A) protruding from the bent portions to a predetermined height above and below the hooks 57 and 57', so as to secure and prevent the hooks 57 and 57' of the springs 56 from separating or moving.

More specifically, in the aforementioned structure, the first hook 57 of the spring 56 is supported on one portion of the U-shaped bent portion of the discharge line tube 31, causing a tension to the other portion of the U-shaped portion on which the second hook 57' is supported. Accordingly, due to the tension of the spring 56, the noise is controlled when the compressed refrigerant is discharged to the discharge pipe 104 through the discharge line tube 31.

Figure 6A:
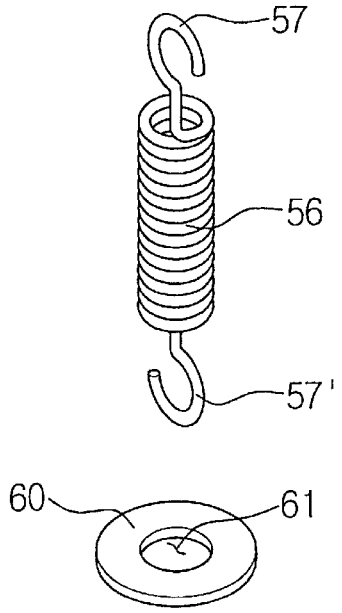
FIGS. 6A and 6B are perspective views showing the elastic member of FIG. 5 being separated and connected, respectively.
Figure 6B:
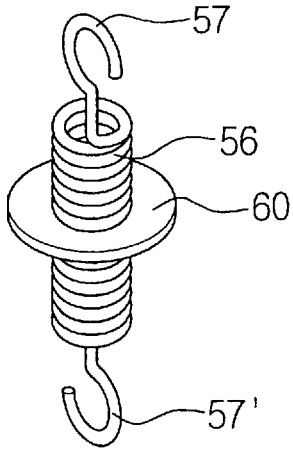

FIGS. 6A and 6B are perspective views showing the spring 56 of FIG. 4 being separated or coupled from/with the mass 60.

FIG. 6A shows the spring 56 with two hooks 57 and 57' formed on both sides for holding the discharge line tube 31, and the mass 60 with a hole 61 defined at the center thereof for receiving the spring 56. FIG. 6B shows the spring 56 being coupled with the mass 60. Here, in order to generate a proper tension, each wire of the extended spring 56 on the discharge line tube 31 has a gap therebetween of approximately more than 0.5 mm. The spring constant may vary depending on the characteristic frequency of the operation of the compressor 200. The mass 60 also may have different thickness 62 and diameter 63, as shown in FIG. 6B. The weight or the mass 60 also may vary depending on the material thereof.

Figure 7A:
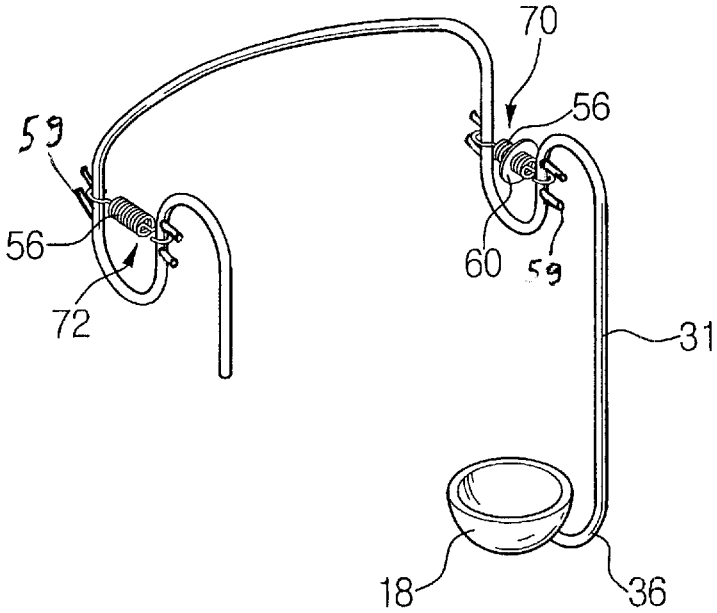
FIGS. 7A through 7C are views showing the discharge line tube and the elastic member of the compressor being disposed around the discharge line tube in accordance with another preferred embodiment of the present invention.
Figure 7B:
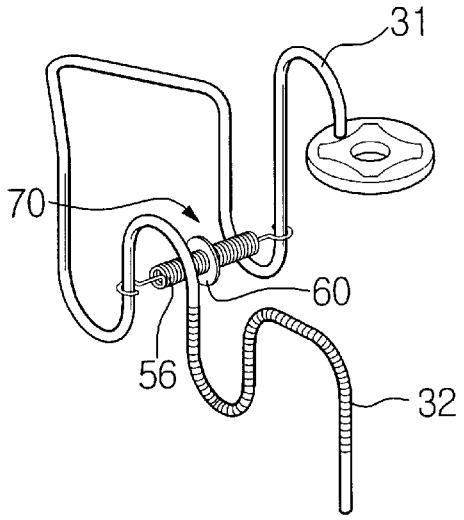
Figure 7C:
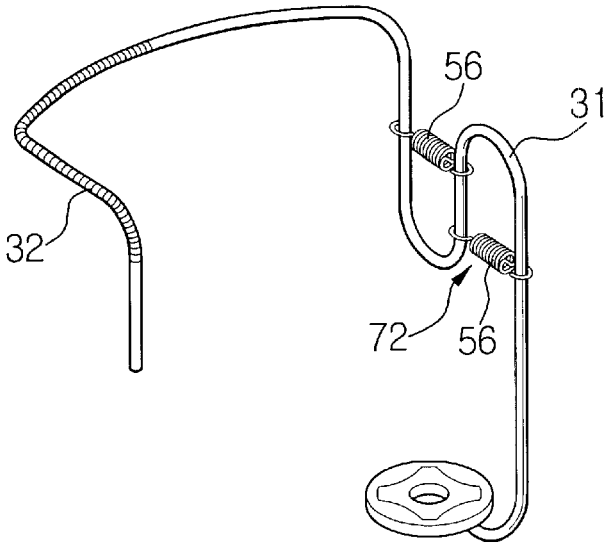

FIGS. 7A through 7C are views showing the discharge line tube 31 having bent portions and the elastic members 70 and 72 disposed on the bent portions of the discharge line tube 31 in accordance with another preferred embodiment of the present invention.

FIG. 7A shows a first elastic member 70 having the spring 56 and the mass 60 coupled with the spring 56, and a second elastic member 72 having the spring 56. FIG. 7A shows the first and second elastic members 70 and 72 being disposed on two bent portions of the discharge line tube 31, respectively, to generate a predetermined tension. FIG. 7B shows the first elastic member 70, i.e., the spring 56 coupled with the mass 60 being disposed between the bent portions of the discharge line tube 31. FIG. 7C shows the second elastic member 72, i.e., the spring 56, being disposed on two bent portions of the discharge line tube 31.

As described above, according to the preferred embodiments of the present invention, by generating a tension on two neighboring portions of the bent portions of the discharge line tube 31, the vibration and noise can be reduced substantially.

Further, since the spring 56 and the mass 60 absorb the noise that is produced by the collision between the coil spring 32 and the spring 56, the noise of the high frequency range can be reduced.

Accordingly, users can have an optimum environment without having to stand the noise of the compressor.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A compressor comprising:

a sealed casing;

a compressing mechanism mounted in the sealed casing, for compressing and discharging an inflow of refrigerant;

a suction pipe passed through the sealed casing, the suction pipe through which the refrigerant flows into the compressing mechanism from outside of the sealed casing;

a discharge pipe passed through the sealed casing, the discharge pipe through which the refrigerant is discharged from the compressing mechanism outside of the sealed casing;

a discharge line tube disposed between the compressing mechanism and the discharge pipe, and having a bent portion for reducing vibration and noise produced during a discharge of the refrigerant; and an elastic member supported on the bent portion of the discharge line tube on two locations for generating a tension.

2. The compressor of claim 1, wherein the elastic member includes a spring.

3. The compressor of claim 2, wherein the elastic member further includes a mass coupled to the spring.

4. The compressor of claim 1, wherein the discharge line tube includes a locking portion for holding the hooks of the elastic member from separation therefrom.

5. The compressor of claim 4, wherein the locking portion includes a locking groove formed on an outer circumference of the discharge line tube by a predetermined depth.

6. The compressor of claim 4, wherein the locking portion includes a locking projection protruding from an outer circumference of the discharge line tube by a predetermined height to above and below the hooks of the elastic member.

* * * * *